US011326422B2

(12) United States Patent
Burky et al.

(10) Patent No.: US 11,326,422 B2
(45) Date of Patent: May 10, 2022

(54) SELF CORRECTING PREDICTION OF ENTRY AND EXIT HOLE DIAMETER

(71) Applicant: Halliburton Energy Services, Inc., Houston, TX (US)

(72) Inventors: Thomas Earl Burky, Mansfield, TX (US); Gerald Graves Craddock, Jr., Mansfield, TX (US); James Harold Wight, Mansfield, TX (US); Jonathan Paul Montiverdi, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/970,161

(22) PCT Filed: May 4, 2018

(86) PCT No.: PCT/US2018/031074

§ 371 (c)(1),
(2) Date: Aug. 14, 2020

(87) PCT Pub. No.: WO2019/212559

PCT Pub. Date: Nov. 7, 2019

(65) Prior Publication Data

US 2021/0062624 A1 Mar. 4, 2021

(51) Int. Cl.
*E21B 43/119* (2006.01)

(52) U.S. Cl.
CPC ..... *E21B 43/119* (2013.01); *E21B 2200/20* (2020.05)

(58) Field of Classification Search
CPC .... E21B 2200/20; E21B 43/119; E21B 11/00; E21B 41/00; E21B 43/117; E21B 47/00
See application file for complete search history.

(56) References Cited

U.S. PATENT DOCUMENTS

| | | | |
|---|---|---|---|
| 5,210,691 | A | 5/1993 | Freedman et al. |
| 6,438,495 | B1 | 8/2002 | Chau et al. |
| 6,581,685 | B2 | 6/2003 | Burgess et al. |
| 7,089,160 | B2 | 8/2006 | Nguyen |
| 7,668,702 | B2 | 2/2010 | Kokotov et al. |
| 7,933,762 | B2 | 4/2011 | Pinto et al. |
| 10,352,153 | B2 * | 7/2019 | Bell ..... E21B 47/007 |

(Continued)

FOREIGN PATENT DOCUMENTS

| | | |
|---|---|---|
| WO | 2012082143 | 6/2012 |
| WO | 2014153084 | 9/2014 |

OTHER PUBLICATIONS

ISRWO International Search Report and Written Opinion for PCT/US2018/031074 dated Jan. 17, 2019.

*Primary Examiner* — Daniel P Stephenson
(74) *Attorney, Agent, or Firm* — John Wustenberg; C. Tumey Law Group PLLC

(57) ABSTRACT

A technique is provided for estimating perforated entry and exit hole diameters (EHD) of a casing string. In one embodiment, a method for predicting perforation outcomes may comprise selecting one or more variables for a perforating operation, determining an estimate of a perforating outcome for the perforating operation, and correcting the perforating outcome to obtain a corrected perforating outcome by applying a weighting based on historical perforating data.

22 Claims, 4 Drawing Sheets

(56) References Cited

U.S. PATENT DOCUMENTS

| | | | | |
|---|---|---|---|---|
| 2003/0168216 | A1 | 9/2003 | Nicholson | |
| 2011/0257944 | A1* | 10/2011 | Du | E21B 43/267 703/2 |
| 2012/0176862 | A1 | 7/2012 | D'Angelo et al. | |
| 2016/0024911 | A1* | 1/2016 | Bell | E21B 43/117 702/12 |
| 2021/0062624 | A1* | 3/2021 | Burky | E21B 41/00 |

* cited by examiner

SELF CORRECTING PREDICTION OF ENTRY AND EXIT HOLE DIAMETER

BACKGROUND

After drilling various sections of a subterranean wellbore that traverses a formation, a casing string may be positioned and cemented within the wellbore. This casing string may increase the integrity of the wellbore and may provide a path for producing fluids from the producing intervals to the surface. To produce fluids into the casing string, perforations may be made through the casing string, the cement, and a short distance into the formation.

These perforations may be created by detonating a series of shaped charges that may be disposed within the casing string and may be positioned adjacent to the formation. Specifically, one or more perforating guns may be loaded with shaped charges that may be connected with a detonator via a detonating cord. The perforating guns may then be attached to a tool string that may be lowered into the cased wellbore. Once the perforating guns are properly positioned in the wellbore such that the shaped charges are adjacent to the formation to be perforated, the shaped charges may be detonated, thereby creating the desired perforations.

The resulting entry and exit hole diameters (EHD) in the casing string created by the detonation are difficult to predict given the variables within a downhole environment. There are often multiple layers within a cased wellbore comprising different materials. Additionally, the perforating guns may be aligned eccentric with the central axis of the wellbore.

BRIEF DESCRIPTION OF THE DRAWINGS

For a detailed description of the preferred embodiments of the invention, reference will now be made to the accompanying drawings in which.

DETAILED DESCRIPTION

This disclosure may generally relate to perforating operations and, more particularly, may generally relate to systems and methods for estimating perforated entry and exit hole diameters (EHD) of a casing string. Those of ordinary skill in the art will readily recognize that the principles described herein are equally applicable to any other suitable perforation outcome. Without limitation, suitable perforation outcomes may be entry hole diameter, exit hole diameter, depth of penetration, wellbore dynamic underbalance pressure, resistance to hydrocarbon flow, and/or combinations thereof. In examples, downhole tools (e.g., a perforating gun assembly) may be used for perforating tubulars, such as, for example a casing string. Perforating gun assemblies may comprise all components required to detonate charges to perforate a casing string. A perforating gun assembly may comprise one or more perforating guns and transfer assemblies configured to transfer ballistic energy from one perforating gun to another perforating gun. Each transfer assembly may comprise an array of explosive elements such as boosters, detonation cord, explosive pellets, shaped charges, and other explosive elements for wellbore use.

The perforating gun assembly may be positioned in a tubular string disposed in a wellbore. The tubular string may be any tubular string such as, without limitation, a work string, production tubing, workover tubing, and combinations thereof. A perforating gun assembly comprising multiple perforating guns and transfer assemblies may allow individual perforating guns to be positioned at multiple points along the tubular string. Each perforating gun may be individually placed on a selected position on the tubular string such that a selected zone may be perforated when the tubing string is positioned within a wellbore. Knowledge of the EHD of a casing string may be required for hydrocarbon production purposes. Oftentimes, there may be numerous variables in the downhole environment that can affect the EHD. Systems and methods may be desired to accurately calculate the EHD of a casing string for a given wellbore.

Figure 1:
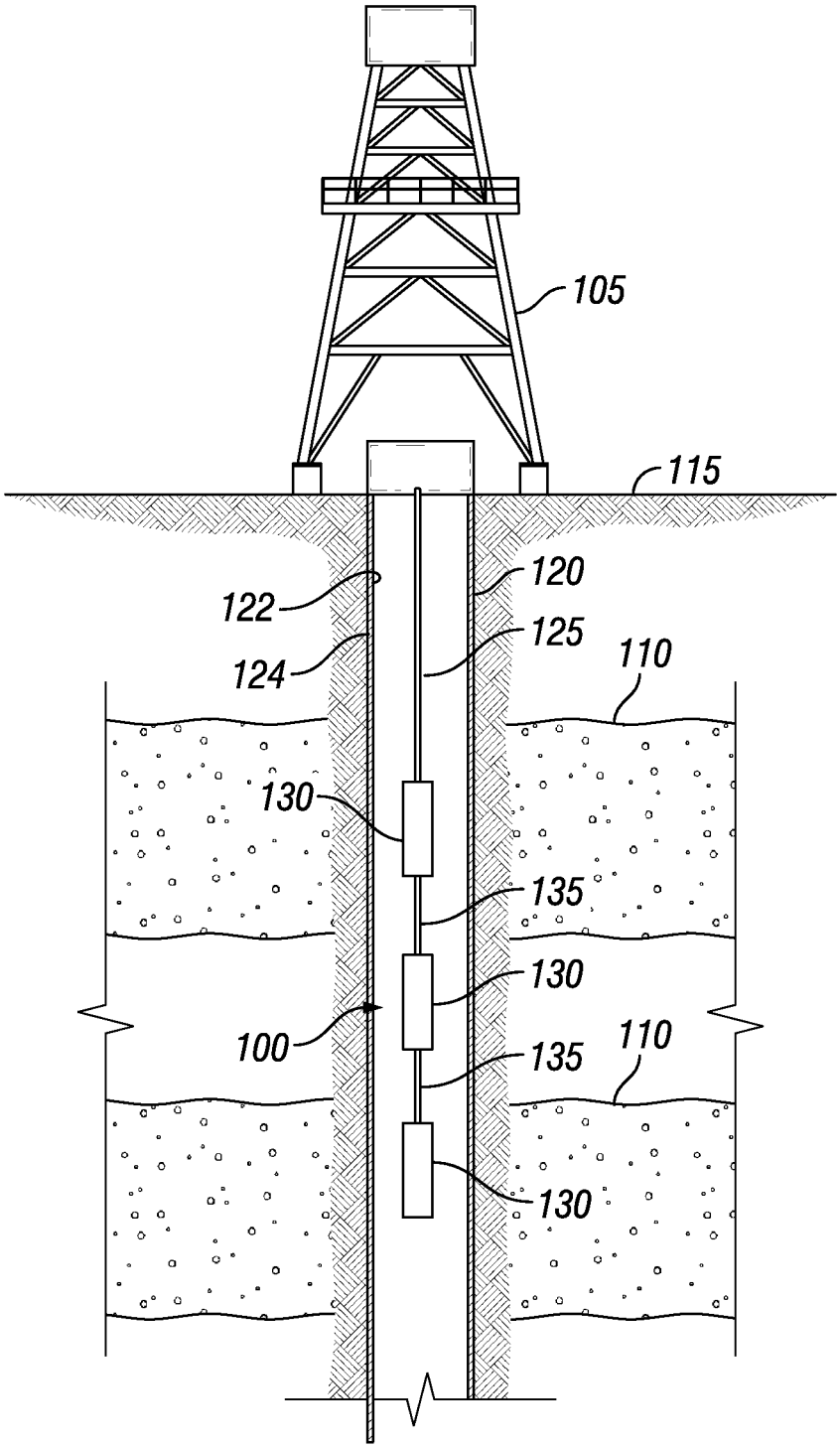
FIG. 1 illustrates an example of a downhole perforating system.

FIG. 1 illustrates an example of a downhole perforating system 100. Rig 105 may be disposed at surface 115. A wellbore 120 may extend from surface 115 to penetrate subterranean formation 110. Wellbore 120 may comprise a casing 122 cemented in place. A conveyance 125 may extent from surface 115 though wellbore 120. Conveyance 125 may include any suitable means for providing mechanical conveyance for downhole perforating system 100, including, but not limited to, wireline, slickline, coiled tubing, pipe, drill pipe, or the like. In some examples, conveyance 125 may provide mechanical suspension, as well as electrical connectivity, for downhole perforating system 100. Downhole perforating system 100 may be positioned such that explosive elements, such as perforating explosives contained within downhole perforating system 100, may perforate casing 122 and into subterranean formation 110. It should be noted that while FIG. 1 generally depicts a land based operation, those of ordinary skill in the art will readily recognize that the principles described herein are equally applicable to subsea systems, without departing from the scope of the disclosure.

Wellbore 120 may extend through the various earth strata including subterranean formation 110. While downhole perforating system 100 is disposed in a vertical section of wellbore 120, wellbore 120 may include horizontal, vertical, slanted, curved, and other types of wellbore geometries and orientations, as will be appreciated by those of ordinary skill in the art. When it is desired to perforate casing 122, the downhole perforating system 100 may be lowered through casing 122 until the downhole perforating system 100 is properly positioned relative to casing 122 and subterranean formation 110. The downhole perforating system 100 may be attached to and lowered via conveyance 125. Thereafter, explosive elements within downhole perforating system 100 may be fired. Explosive elements contained in the perforating gun assemblies may comprise shaped charges, which upon detonation may form jets that may create a spaced series of perforations extending outwardly through 122 casing, cement 124, and into subterranean formation 110, thereby allowing formation communication between subterranean formation 110 and wellbore 120. In addition to the use of shaped charges, the downhole perforating system 100 may be readily substituted with similar tools that contain other oilfield ordinance such as propellants or venting devices known to those of ordinary skill in the art.

Downhole perforating system 100 may include one or more perforating guns 130. Perforating guns 130 may be any suitable device for perforating subterranean formation 110, as explained in further detail below. Without limitation, perforating guns 130 may include various components (none shown separately), including, but not limited to, a firing head, a handling subassembly, a gun subassembly, and/or combinations thereof. Additional examples of perforating guns 130 may include, but are not limited to, tubing cutters and setting tools. In examples, a detonation transfer line 135 may extend between and connect perforating guns 130 to one another. Detonation transfer line 135 may transfer a detonation charge across a distance between perforating guns 130.

Figure 2:
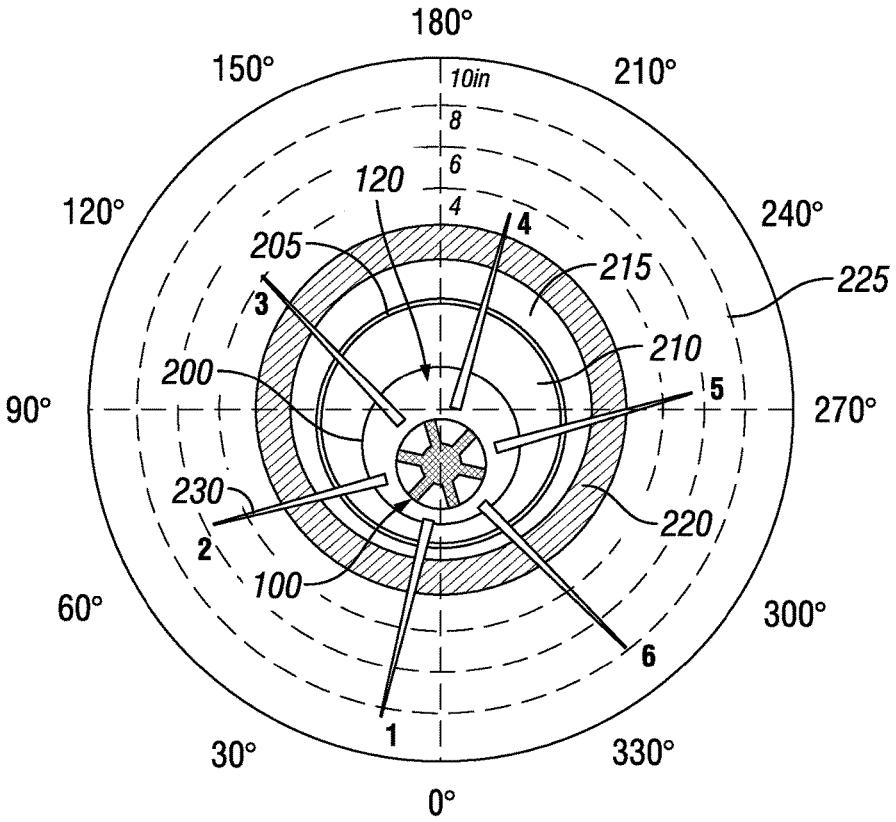
FIG. 2 illustrates a top-view of a perforated wellbore

FIG. 2 illustrates a top-view of wellbore 120 after perforation. In examples, downhole perforating system 100 may perforate aligned within wellbore 120 or eccentric to the central axis of wellbore 120. In examples, there may be a plurality of casing strings, layers of concrete, and layers of fluid disposed around wellbore. Wellbore 120 may include of a first casing 200, a second casing 205, a first layer of concrete 210, a second layer of concrete 215, a layer of fluid 220, and a surrounding formation 225. As downhole perforating system 100 detonates, a shaped jet 230 may be produced. There may be a plurality of shaped jets 230. The potential energy from the shaped charges within downhole perforating system 100 may cause shaped jets 230 to propagate outward. Shaped jets 230 may pierce through first casing 200, second casing 205, first layer of concrete 210, second layer of concrete 215, layer of fluid 220, surrounding formation 225, and/or combinations thereof. The shaped jets 230 should result in formation of corresponding perforations in first casing 200, second casing 205, first layer of concrete 210, second layer of concrete 215, layer of fluid 220, and/or surrounding formation 225. The material properties of the different layers may inhibit further propagation of shaped jet 230. Shaped jet 230 may not travel through all the layers prior to surrounding formation 225. In examples, there may be a difference of depth of penetration between a plurality of shaped jets 230. Some shaped jets 230 may travel further into surrounding formation 225 than others. Some shaped jets may stop propagating prior to reaching surrounding formation 225. It may be difficult to determine how many shaped jets 230 were able to propagate into surrounding formation 225 or if any had reached surrounding formation 225 at all. If shaped jets 230 were able to propagate into surrounding formation 225, it may be useful to predict the depth of penetration and/or the EHD of casing strings, such as first casing 200 and second casing 205. That information may help predict accurate production rates.

To estimate projected jet path and, thus, perforations, the projected jet path of each individual shaped charge may be calculated. The calculation may start with a value for the maximum depth of penetration and maximum hole size of a casing string based on the potential energy of a shaped charge. As the shaped charge is detonated, the jet path may proceed through a first layer of material. As the jet path proceeds, a portion of the jet path's energy may be consumed. Subsequently, the values of maximum depth of penetration and maximum hole size of a casing string may be reduced. The reduced values may be the values of maximum depth of penetration and maximum hole size of a casing string as the jet path exits a first layer of material and may be known as "penetration remaining" and "hole size remaining." The reduced values may be used as the initial values for a second layer of material in the jet path. The process may be repeated for each subsequent layer until the penetration remaining value equals zero and/or the hole size remaining value is less than a designated value. In examples, the designated value may be 0.05 inches (1.3 mm). However, due to assumptions that simplify the calculations, errors may occur leading in inaccuracies between the estimate of the holes size that are determined and actual test data. To increase the accuracy of the estimates of hole size, corrections may be applied to the estimates of hole size. If there is historical perforating data that is available and that matches (or closely matches) the given scenario, for example, materials, thicknesses, spacing, etc., the estimate of the hole size may be corrected using the test data.

In examples, perforator gun systems may be multi-directional in that their perforations are phased around the gun in a spiral, or spirals, that proceed down the length of the gun. Perforator guns may be designed to a have a pattern that repeats after a certain number of shaped charges are fires, as determined by the phase angle of the charges. It may be unusual for multiple casing layers to be perfectly centralized relative to one another. Therefore, the perforation jet path of each shot of the pattern may be unique with respect to the relative thickness of each layer it traverses, as illustrated in FIG. 2. As depicted, the thickness of each layer will be different for each jet path due to the angle the jet may take through the material. These differences may have an impact on the total penetration of each jet and its resultant hole size in each casing. With these influences, the estimation of expected performance of each jet path may be beyond the application of "rule of thumb." Each jet path may be required to be modeled individually.

Figure 3:
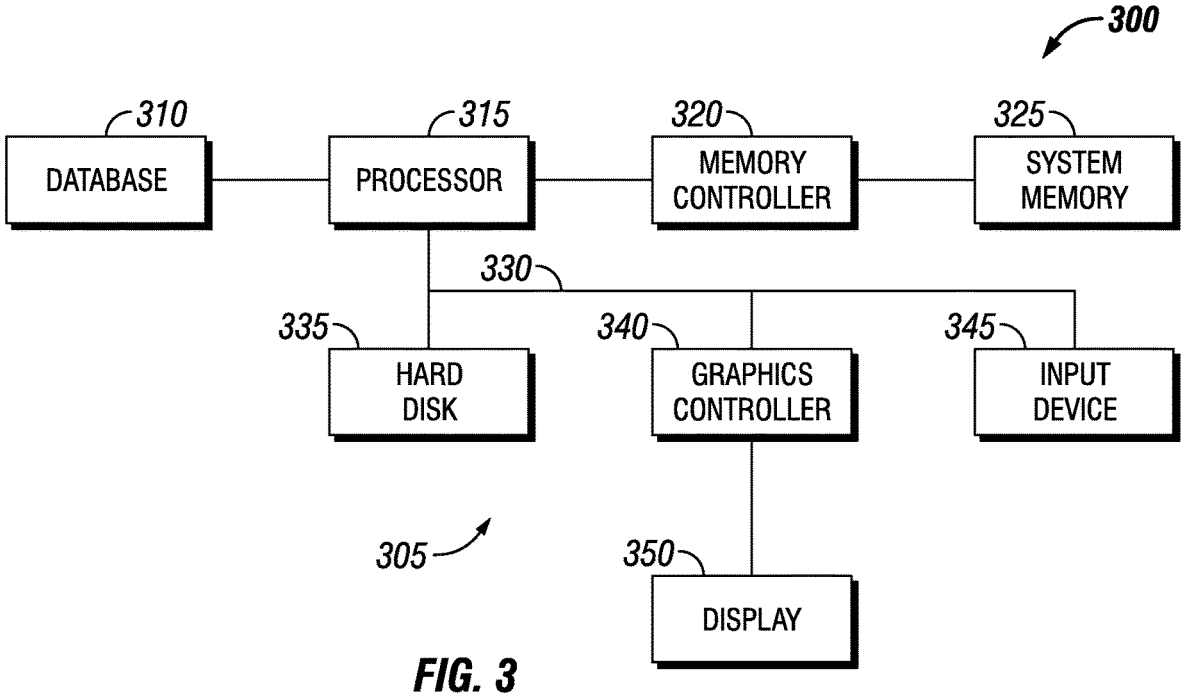
FIG. 3 illustrates an example of a prediction system.

FIG. 3 illustrates an example of a prediction system 300. Prediction system 300 may predict a perforation outcome, such as the entry and/or exit hole diameter for a perforated casing string. Prediction system 300 may predict the EHD for a wellbore having a singular casing string and/or multiple casing strings. Prediction system 300 may calculate the projected jet path (i.e., whether the jet path reaches the formation or is stopped at an intermediate layer). Prediction system 300 may include an information handling system 305 and a database 310.

Information submitted by an operator may be processed by information handling system 305. Information handling system 305 may categorize potential wellbore materials to be perforated into a specific class. There may be a plurality of specific classes. In examples, there may be eight different specific classes. The specific classes may be include, but are not limited to, steel, water, mud, concrete, and/or combinations thereof. In examples, steel may be divided into sub-classes. The sub-classes may be divided based on any suitable parameter. In examples, the sub-classes may be divided based on yield strength. For each specific class, there may be adjustable parameters for each shaped charge. In examples, the adjustable parameters may include a maximum possible penetration depth for each potential wellbore material, a power operator for efficiency of penetration as a function of depth of penetration, and a power operator for efficiency of hole size as a function of depth of penetration. Information handling system 305 may process the information submitted by an operator, and the resulting information may be displayed for an operator to observe and stored for future processing and reference.

Information handling system 305 may be located at surface 115 or at another location, such as remote from wellbore 120 (referring to FIG. 1). Information handling system 305 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 305 may be a processing unit, a network storage device, or any other suitable device and may vary in size, shape, performance, functionality, and price. Information handling system 305 may include random access memory (RAM), one or more processing resources such as a central processing unit (CPU) or hardware or software control logic, ROM, and/or other types of nonvolatile memory. Additional components of the information handling system 305 may include one or more disk drives, one or more network ports for communication with external devices as well as an input device (e.g., keyboard, mouse, etc.) and video display. Information handling system 305 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing. Information handling system 305 may be coupled to database 310 through electrically conductive wiring, fiber optic cables, a wireless connection, and/or combinations thereof.

Software for performing method steps may be stored in information handling system 305 and/or on external computer readable media. Those of ordinary skill in the art will appreciate that information handling system 305 may include hardware elements including circuitry, software elements including computer code stored on a machine-readable medium or a combination of both hardware and software elements. Additionally, the blocks shown are but one example of blocks that may be implemented. A processor 315, such as a central processing unit or CPU, controls the overall operation of information handling system 305. The processor 315 may be connected to a memory controller 320, which may read data to and write data from a system memory 325. The memory controller 320 may have memory that includes a non-volatile memory region and a volatile memory region. The system memory 325 may be composed of a plurality of memory modules, as will be appreciated by one of ordinary skill in the art. In addition, the system memory 325 may include non-volatile and volatile portions. A system basic input-output system (BIOS) may be stored in a non-volatile portion of the system memory 325. The system BIOS may be adapted to control a start-up or boot process and to control the low-level operation of information handling system 305.

As illustrated, the processor 315 may be connected to at least one system bus 330, for example, to allow communication between the processor 315 and other system devices. The system bus may operate under a standard protocol such as a variation of the Peripheral Component Interconnect (PCI) bus or the like. In the exemplary example shown in FIG. 3, the system bus 330 may connect the processor 315 to a hard disk drive 335, a graphics controller 340 and at least one input device 345. The hard disk drive 335 may provide non-volatile storage to data that is used by information handling system 305. The graphics controller 340 may in turn be connected to a display device 350, which provides an image to a user based on activities performed by information handling system 305. The memory devices of information handling system 305, including the system memory 325 and the hard disk drive 335 may be tangible, machine-readable media that store computer-readable instructions to cause the processor 315 to perform a method according to an example of the present techniques. In examples, information handling system 305 may be coupled to database 310. Processor 315 may extract data from database 310 to be manipulated by information handling system 305.

Database 310 may be an organized collection of perforating data. Database 310 may be located within physical hardware and/or may utilize cloud computing. In examples, database 310 may include historical perforating data conducted in wellbores. In examples, there may be data produced from over 1,000 perforation tests in varying conditions. This data may be acquired by reproducing a testing scenario of perforation of a wellbore above surface or in a lab. The data may be organized in any suitable manner preferable to an operator. The data may include, but is not limited to, the type of ballistic device used in the perforating gun assembly, the type of charge, the eccentricity of the perforating gun assembly with the central axis of the wellbore, the type of wellbore material to be perforated, the thickness of a casing string, and/or combinations thereof. This data may be correlated with various perforation outcomes that were achieved in various test reports.

In examples, prediction system 300 may predict a perforation outcome, such as the EHD of a casing string for detonation of a perforating gun assembly while taking into account a plurality of varying factors. Prediction system 300 may estimate a perforation outcome and then correct the perforation outcome using the data from the database 310 to obtain a corrected perforation outcome. Prediction system 300 may reduce the margin of error between the previously estimated perforation outcome (e.g., estimated EHD) and the actual perforating outcome (e.g., actual EHD) after detonation by considering the various factors in the downhole environment from the database 310. Prediction system 300 may simulate the process of detonation multiple times prior to operation within wellbore 120 (e.g., referring to FIG. 1). This may increase the efficiency of perforating a wellbore and may decrease the cost of potential mistakes.

Figure 4:
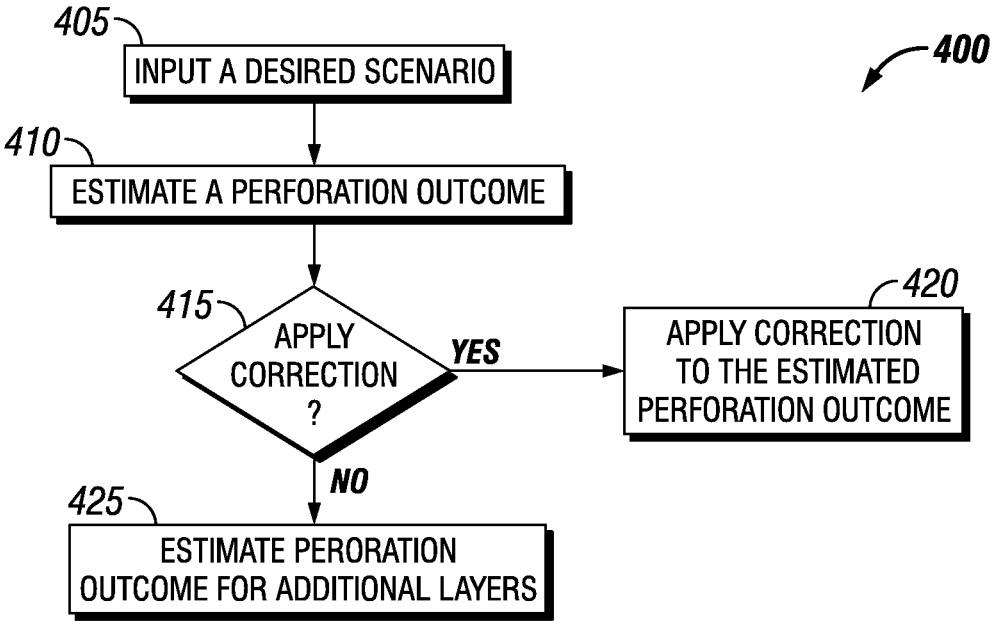
FIG. 4 illustrates an example of a flowchart 400 that may initiate calculation of a projected jet path.

FIG. 4 illustrates an example of a flowchart 400 that may initiate calculation of a projected jet path. Flowchart 400 may be used to decide whether an operator should apply the correction to an estimate of the perforation outcome, for example, using prediction system 300 shown on FIG. 3. First step 405 may include an operator inputting a desired scenario. The operator may input at least one of the varying factors previously described. In examples, the operator may input a plurality of the varying factors. Second step 410 may include estimating a perforation outcome for first casing. The perforation outcome may be estimated, for example, by calculating the shot pattern of a perforating gun assembly and analyzing each individual jet path to generate an estimate of a perforation outcome. Any of a variety of suitable techniques may be used to estimate the perforation outcomes. Decision step 415 may include a logical decision. Decision step 415 may split the flow of commands between two outcomes. Decision step 415 may include deciding whether or not to apply a correction to the estimated perforation outcome from second step 410. The decision may further include determining whether or not there is a test report within database 310 (e.g., referring to FIG. 1)

with the same varying factors inputted by the operator for the first casing. Without limitation, any suitable number of varying factors may be used. If there is a test report within database 310 with the same varying factors inputted by the operator, the flow of operation may proceed to correction scheme 420 where a correction may be applied to the estimated perforation outcome from second step 410 and perforation outcome for the remaining layers may be calculated. The correction may include utilizing historical perforating data, as previously described, to obtain a corrected perforation outcome. As described above, prediction system 300 may be used for the correction. If no correction is applied, the flow of operation continues on to estimation scheme 425 where perforation outcomes may be estimated for additional layers.

Figure 5:
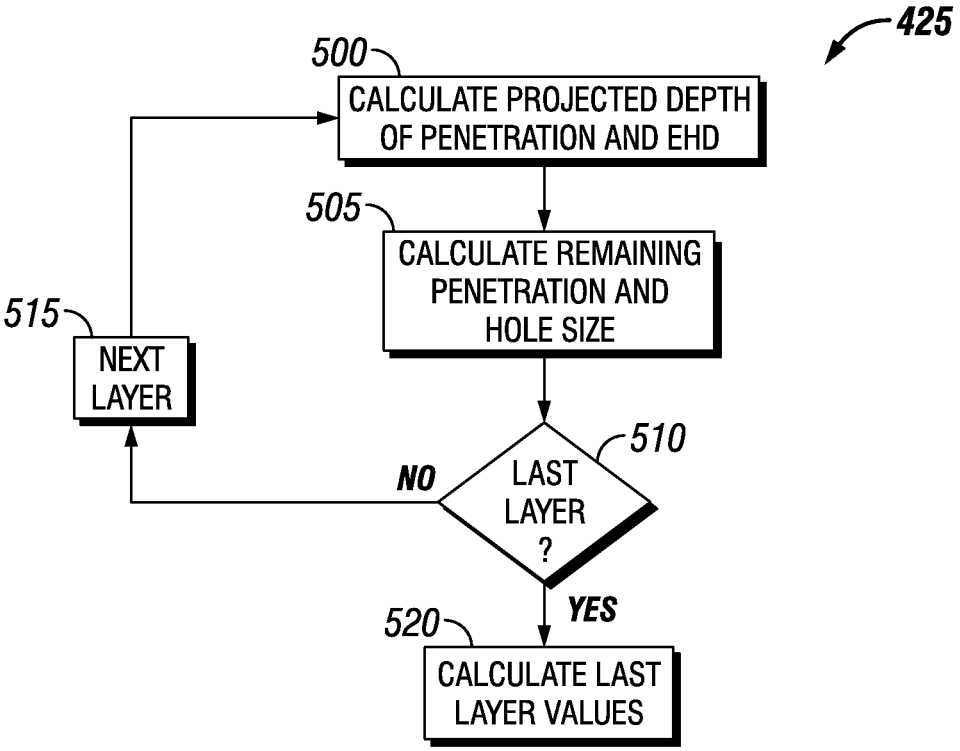
FIG. 5 illustrates an estimation scheme for perforation outcomes.

FIG. 5 illustrates an example of estimation scheme 425 in more detail where no correction is applied. If no correction is applied, any suitable technique used within industry may be used to calculate perforation outcomes. In this example, step 500 may include calculating the projected depth of penetration and EHD for the current layer (e.g., casing layer). Second step 505 may include calculating the penetration remaining and hole size remaining values as the projected jet path passes through the current layer. Decision step 510 may include a logical decision. Decision step 510 may split the flow of commands between two outcomes. Decision step 510 may include deciding whether or not the current layer is the last layer of wellbore material. In examples, the operator may indicate the decision. If the current layer is not the last layer of wellbore material, estimation scheme 425 may continue to repeat step 500, second step 505, and decision step 510 for each additional layer of wellbore material until the current layer is the last layer of wellbore material. An intermediate step 515 may occur between a repetition of step 500, second step 505, and decision step 510. Intermediate step 515 may include indicating to the operator that estimation scheme 425 will be used for the next layer of wellbore material. If the current layer is the last layer of wellbore material, a first conclusion 520 may end correction scheme 420. First conclusion 520 may represent the interface between a last layer of wellbore material and a formation. First conclusion 520 may include calculating the penetration remaining and hole size remaining values of the projected jet path as it exits the last layer. These values may be the initial values to be used in a separate process for determining how far the projected jet path will travel into a formation.

Figure 6:
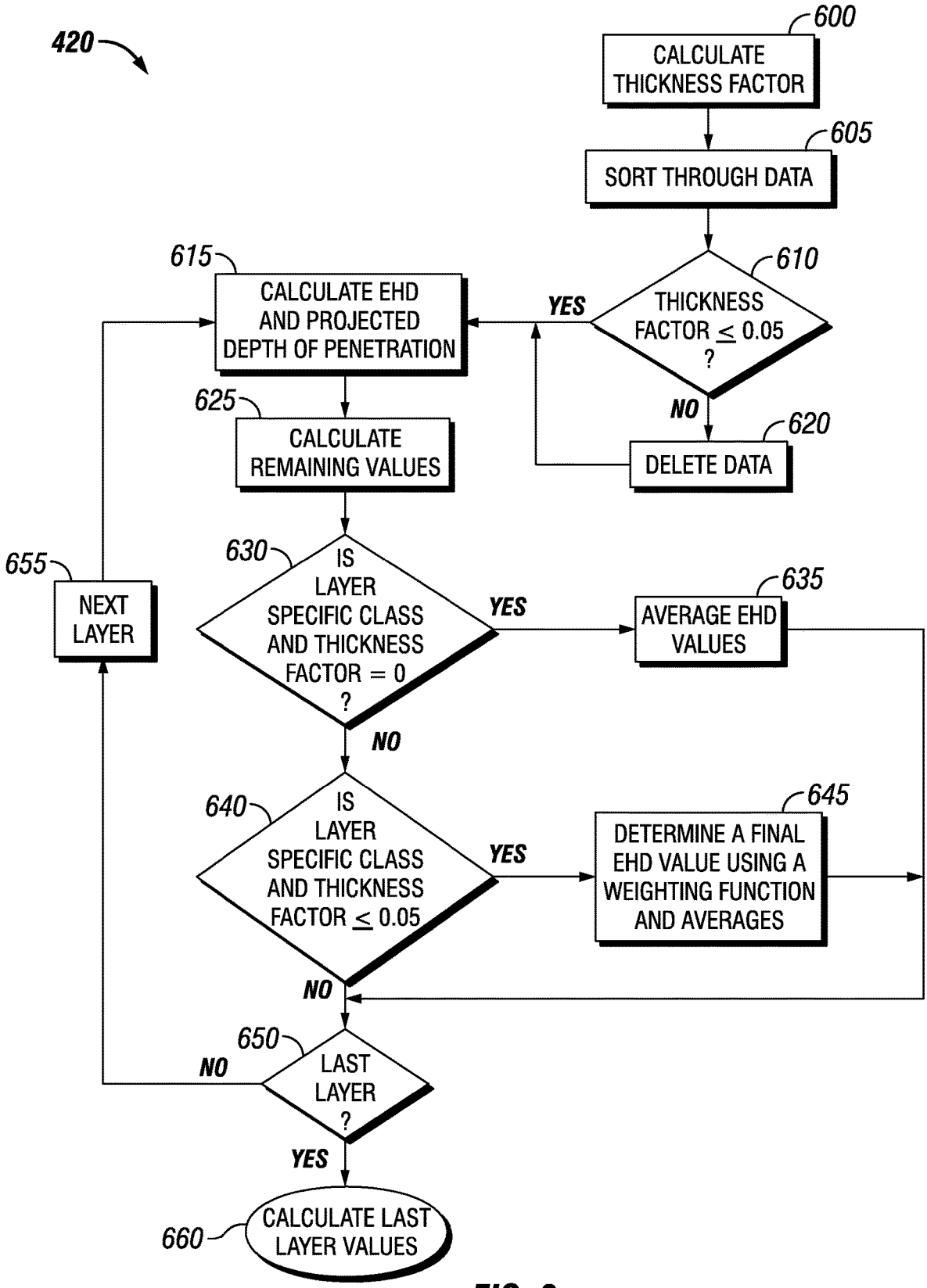
FIG. 6 illustrates a correction scheme for correcting perforation outcomes.

FIG. 6 illustrates an example of correction scheme 420 for application of corrections to an estimate of perforation outcome. The following is a description of an example of a correction scheme 420, but it should be understood that present techniques should be limited to the following description. Correction scheme 420 may be used if a test report in database 310 (referring to FIG. 3) matches the data inputted by the operator. There may be a plurality of test reports that match the data inputted by the operator. Step 600 may include calculating a thickness factor concerning all material layers in a test report representing the perforating gun assembly's clearance to the back side of the last layer that is a casing string. Step 600 may be a sensitivity function. In examples, the sensitivity function may have two variables. Without limitation, the two variables may be the layer thickness entered by the operator and the layer thickness in a test report. In examples, there may be an upper limit and/or a lower limit for the value of the thickness factor. If the thickness factor is equal to the lower limit, then there is an exact match between a test report within database 310 (referring to FIG. 3) and the operator inputted data. As the thickness factor approaches the upper limit, the data from a test report may deviate from the data the operator had provided. If the thickness factor is equal to or greater than the upper limit, the data within a test report becomes erroneous when compared to the data provided by the operator. After calculating the thickness factor, step 600 may store the thickness factor, material type, and EHD value for each layer from a test report into a table. The table may include data (i.e., a data table) for a plurality of layers within a wellbore.

Data sorting step 605 may include sorting through the data stored in the table created in step 600. The operator may start the sorting process at the first layer closest to the perforating gun assembly. The operator may delete the layer's data, as well as any subsequent layers' data, if the data does not match suitable criteria. Suitable criteria may be that the material type does not match the value that the operator had inputted, the gun scallop thickness may be undefined, the casing string's outer diameter value may be undefined, the casing thickness may be undefined, and/or combinations thereof. The suitable criteria may be able to catch errors in database 310 (referring to FIG. 3) or facilitate the deletion of incomplete sets, wherein certain fields may be null. In examples, if the first layer matches suitable criteria, the operator may move on to sort a second layer. If the second layer does not match suitable criteria, the operator may delete that layer's data, as well as any subsequent layers' data.

Decision step 610 may include a logical decision. Decision step 610 may split the flow of commands between two outcomes. Decision step 610 may include deciding whether or not each remaining layers' corresponding thickness value is less than or equal to a threshold. The threshold may be a designated value. In examples, the designated value may be 0.05. If each remaining layers' corresponding thickness value is less than or equal to 0.05, a current value step 615 may be implemented. If each remaining layers' corresponding thickness value is greater than 0.05, a deletion step 620 may occur before current value step 615. Deletion step 620 may include deleting all of the current layer's data as well as all any subsequent layers' data from the table generated in step 600.

Current value step 615 may include calculating the projected depth of penetration and EHD for the current layer. Remaining value step 625 may include calculating the penetration remaining and hole size remaining values as the projected jet path passes through the current layer.

Second decision step 630 may include a logical decision. Second decision step 630 may split the flow of commands between two outcomes. Second decision step 630 may include deciding whether or not the current layer material is a specific class and whether or not there is a test report whose thickness value equals a lower limit specified by the operator. In examples, the lower limit may be 0. In examples, the specific class may be steel. If the current layer material is the same as the specific class and the thickness value is equal to the lower limit, an averaging step 635 may be implemented.

Averaging step 635 may include averaging all the EHD values for the current layer with all the test reports. There may be a single test report that matches the previously discussed qualifications or there may be a plurality of test reports. If there is a single test report, the EHD value for the current layer may be reported as the EHD value for the projected jet path of the current layer. If there is a plurality of test reports, their EHD values may be averaged together, and the averaged value may be reported as the EHD value for the projected jet path of the current layer.

If the current layer material is the same as the specific class and the thickness value is not equal to the lower limit, a third decision step 640 may be implemented. Third decision step 640 may include a logical decision. Third decision step 640 may split the flow of commands between two outcomes. Third decision step 640 may include deciding whether or not the current layer material is a specific class and whether or not there is a test report whose thickness value is greater than a lower limit threshold and less than or equal to an upper limit threshold, wherein both the lower limit threshold and upper limit threshold are specified by the operator. In examples, the lower limit threshold may be 0, the upper limit threshold may be 0.05, and the specific class may be steel. If the current layer material is the same as the specific class and the thickness value is greater than a lower limit threshold and less than or equal to an upper limit threshold, a correction scheme step 645 may be implemented.

Correction scheme step 645 may include a plurality of computations to determine a weighted EHD value to be reported for the projected jet path of the current layer. This may be done by a weighting function to attribute more weight to test reports that may have more similar thickness values than others. In examples, the operator may want the final EHD value to correlate more with a test report whose thickness value of the current layer is off by 5% rather than with a test report whose thickness value is off by 15%. In examples, correction scheme step 645 may determine the weighting of the thickness values for the current layer attributed to a plurality of test reports. The weighted thickness value may be used to bias the EHD values in the plurality of test reports for the current layer. Correction scheme step 645 may calculate the average thickness value of the plurality of test reports. The biased EHD value, the EHD value that the existing method 420 (referring to FIG. 4) may calculate, and the averaged thickness value may be used in a calculation to find a final EHD value to be reported for the projected jet path of the current layer.

Either after third decision step 640 or after correction scheme step 645, a last layer step 650 may occur. Last layer step 650 may split the flow of commands between two outcomes. Last layer step 650 may include deciding whether or not the current layer material is the last layer of wellbore material. In examples, the operator may indicate the decision. If the current layer is not the last layer of wellbore material, prediction system 300 (referring to FIG. 3) may continue to repeat current value step 615, remaining value step 625, second decision step 630, averaging step 635, third decision step 640, correction scheme step 645, and/or combinations thereof until the current layer is the last layer of wellbore material. A next layer step 655 may occur between last layer step 650 and current value step 615. Next layer step 655 may include indicating to the operator that prediction system 300 will be used for the next layer of wellbore material. If the current layer is the last layer of wellbore material, a second conclusion 660 may end prediction system 300. Second conclusion 660 may represent the interface between a last layer of wellbore material and a formation. Second conclusion 660 may include calculating the penetration remaining and hole size remaining values of the projected jet path as it exits the last layer. These values may be the initial values to be used in a separate process for determining how far the projected jet path will travel into a formation.

The calculation of perforation hole size from correction scheme 420 may enable determination of the pressure drop across a layer of casing and thus may drive the ability to extract fluids from the well (e.g., profitability), the capital equipment investment required to inject fluids into a well, the effectiveness to pump concrete behind the casing to effectively plug the well (i.e. potential environmental damage), and/or combinations thereof. In examples, if the estimated hole size is not accurate, the wrong charge may be selected for use in a perforating operation. If perforation is intended for oil production, incorrect hole size may result in inefficient hydraulic fracturing and underproduction of oil and/or other hydrocarbons. If the perforation is intended for plug and abandonment of a well, an incorrect hole size may result in poor inter-annular fluid flow and therefore a poor concrete plug seal, resulting in a leak of oil to the surface and environmental damage. Different perforation systems may be selected based on the tradeoff of relative hole size and depth of penetration produced from each system. For example, the perforation hole size may be used to select any number of aspects of the perforating operation, including, but not limited to, the perforation charge, the type of perforation gun, and the number of perforation guns, among other aspects. By adjusting these and other aspects of the perforating operation, a desired perforation hole size may be achieved. Correction scheme 420 may help to bridge the gap between known penetration perforating data and novel scenarios.

The systems and methods for applying a correction scheme for estimating a hole size may include any of the various features of the systems and methods disclosed herein, including one or more of the following statements.

Statement 1. A method for predicting perforation outcomes, comprising: selecting one or more variables for a perforating operation; determining an estimate of a perforating outcome for the perforating operation; and correcting the perforating outcome to obtain a corrected perforating outcome by applying a weighting based on historical perforating data.

Statement 2. The method of statement 1, further comprising performing the perforating operation to create one or more perforations in a wellbore and comparing an actual perforation outcome to the corrected perforation outcome.

Statement 3. The method of any preceding statement, further comprising adjusting at least one aspect of the perforating operation based on the perforating outcome, and performing the perforating operation to create one or more perforations in a wellbore.

Statement 4. The method of any preceding statement, wherein the variables comprise at least one variable selected from the group consisting of type of ballistic device used in a perforating gun assembly, type of charge, eccentricity of the perforating gun assembly with a central axis of a wellbore, type of wellbore material to be perforated, thickness of a casing string, and combinations thereof.

Statement 5. The method of any preceding statement, wherein the perforating outcome comprises at least one outcome selected from the group consisting of entry hole diameter, exit hole diameter, depth of penetration, wellbore dynamic underbalance pressure, resistance to hydrocarbon flow, and combinations thereof.

Statement 6. A method for predicting perforation outcomes, comprising: selecting one or more variables for a perforating operation, wherein the variables comprise thickness of wellbore layers to be perforated and type of material of the wellbore layers to be perforated; obtaining historical perforating data for a plurality of perforation tests, wherein the perforation tests comprise data for perforating through a plurality of perforated wellbore layers; calculating a thickness factor for a first perforated layer for each of the perforating tests, wherein the first perforated layer is a current layer, wherein the thickness factor is a function of thickness of a first layer of the wellbore layers to be perforated and a thickness of the current layer in the respective one of the perforation tests; determining an estimate of a perforating outcome for the current layer of the wellbore layers to be perforated; and correcting the perforating outcome to obtain a corrected perforating outcome where the thickness factor for at least one of the perforation tests is equal to or below a threshold.

Statement 7. The method of statement 6, further comprising determining the last layer of material.

Statement 8. The method of statement 6 or 7, further comprising generating a data table storing the thickness factor, material type, and entrance hole diameter value of the current layer, wherein the data table comprises a plurality of layers from a wellbore.

Statement 9. The method of any of statements 6 to 8, wherein the thickness factor is greater than the threshold.

Statement 10. The method of statement 9, further comprising deleting data for the current layer, and all subsequent layer data, from the data table.

Statement 11. The method of any of statements 6 to 10, wherein the thickness factor is equal to a lower limit of the threshold.

Statement 12. The method of statement 11, further comprising averaging estimate hole diameter values for the current layer from the plurality of perforation tests.

Statement 13. The method of any of statements 6 to 12, wherein the thickness factor is greater than a lower limit of the threshold and is equal to or less the threshold.

Statement 14. The method of any of statements 6 to 13, wherein the correcting the perforating outcome comprises of applying a weighting function based on the thickness factor for at least one of the perforation tests that is equal to or below the threshold and greater than a lower limit of the threshold.

Statement 15. The method of statement 14, wherein the weighting function is used to bias estimated hole diameter values from the plurality of perforation tests.

Statement 16. The method of any of statements 6 to 15, further comprising calculating remaining depth of penetration and estimated hole diameter value of the last layer.

Statement 17. The method of any of statements 6 to 16, further comprising calculating depth of penetration and estimated hole diameter value of the current layer.

Statement 18. A prediction system for perforation outcomes comprising: database comprising a collection of perforating data; and an information handling system comprising a processor and memory coupled to the processor, wherein the memory stores a program configured to: obtain one or more variables for a perforating operation; determine an estimate of a perforating outcome for the perforating operation; and correct the perforating outcome to obtain a corrected perforating outcome by applying a weighting based on the perforating data from the database.

Statement 19. The prediction system of statement 18, wherein the variables comprise thickness of wellbore layers to be perforated and type of material of the wellbore layers to be perforated, wherein the perforating data comprises perforating data for a plurality of perforation tests, wherein the perforation tests comprise data for perforating through a plurality of perforated wellbore layers.

Statement 20. The prediction system of statement 19, wherein the program is further configured to calculate a thickness factor for a first perforated layer for each of the perforating tests, wherein the first perforated layer is a current layer, wherein the thickness factor is a function of thickness of a first layer of the wellbore layers to be perforated and a thickness of the current layer in the respective one of the perforation tests, wherein the estimate of the perforating operation is an estimate of a perforating outcome for the current layer of the wellbore layers to be perforated, and wherein perforating outcome is corrected where the thickness factor for at least one of the perforation tests is equal to or below a threshold.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of or" consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for predicting perforation outcomes, comprising:

selecting one or more variables for a perforating operation;

determining an estimate of a perforating outcome for the perforating operation based at least on a plurality of jet paths, wherein the plurality of jet paths comprises a different angle or a different depth of penetration for each jet path at a single depth; and correcting the perforating outcome to obtain a corrected perforating outcome by applying a weighting based on historical perforating data.

2. The method of claim 1, further comprising performing the perforating operation to create one or more perforations in a wellbore and comparing an actual perforation outcome to the corrected perforation outcome.

3. The method of claim 1, further comprising adjusting at least one aspect of the perforating operation based on the perforating outcome, and performing the perforating operation to create one or more perforations in a wellbore.

4. The method of claim 1, wherein the variables comprise at least one variable selected from the group consisting of type of ballistic device used in a perforating gun assembly, type of charge, eccentricity of the perforating gun assembly with a central axis of a wellbore, type of wellbore material to be perforated, thickness of a casing string, and combinations thereof.

5. The method of claim 1, wherein the perforating outcome comprises at least one outcome selected from the group consisting of entry hole diameter, exit hole diameter, depth of penetration, wellbore dynamic underbalance pressure, resistance to hydrocarbon flow, and combinations thereof.

6. A method for predicting perforation outcomes, comprising:

selecting one or more variables for a perforating operation, wherein the variables comprise thickness of wellbore layers to be perforated and type of material of the wellbore layers to be perforated;

obtaining historical perforating data for a plurality of perforation tests, wherein the perforation tests comprise data for perforating through a plurality of perforated wellbore layers;

calculating a thickness factor for a first perforated layer for each of the perforating tests, wherein the first perforated layer is a current layer, wherein the thickness factor is a function of thickness of a first layer of the wellbore layers to be perforated and a thickness of the current layer in the respective one of the perforation tests;

determining an estimate of a perforating outcome for the current layer of the wellbore layers to be perforated; and correcting the perforating outcome to obtain a corrected perforating outcome where the thickness factor for at least one of the perforation tests is equal to or below a threshold.

7. The method of claim 6, further comprising determining the last layer of material.

8. The method of claim 6, further comprising generating a data table storing the thickness factor, material type, and entrance hole diameter value of the current layer, wherein the data table comprises a plurality of layers from a wellbore.

9. The method of claim 6, wherein the thickness factor is greater than the threshold.

10. The method of claim 9, further comprising deleting data for the current layer, and all subsequent layer data, from the data table.

11. The method of claim 6, wherein the thickness factor is equal to a lower limit of the threshold.

12. The method of claim 11, further comprising averaging estimate hole diameter values for the current layer from the plurality of perforation tests.

13. The method of claim 6, wherein the thickness factor is greater than a lower limit of the threshold and is equal to or less the threshold.

14. The method of claim 6, wherein the correcting the perforating outcome comprises of applying a weighting function based on the thickness factor for at least one of the perforation tests that is equal to or below the threshold and greater than a lower limit of the threshold.

15. The method of claim 14, wherein the weighting function is used to bias estimated hole diameter values from the plurality of perforation tests.

16. The method of claim 6, further comprising calculating remaining depth of penetration and estimated hole diameter value of the last layer.

17. The method of claim 6, further comprising calculating depth of penetration and estimated hole diameter value of the current layer.

18. A prediction system for perforation outcomes comprising:

database comprising a collection of perforating data; and an information handling system comprising a processor and memory coupled to the processor, wherein the memory stores a program configured to:

obtain one or more variables for a perforating operation;

determine an estimate of a perforating outcome for the perforating operation based at least on a plurality of jet paths, wherein the plurality of jet paths comprises a different angle or a different depth of penetration for each jet path at a single depth; and correct the perforating outcome to obtain a corrected perforating outcome by applying a weighting based on the perforating data from the database.

19. The prediction system of claim 18, wherein the variables comprise thickness of wellbore layers to be perforated and type of material of the wellbore layers to be perforated, wherein the perforating data comprises perforating data for a plurality of perforation tests, wherein the perforation tests comprise data for perforating through a plurality of perforated wellbore layers.

20. The prediction system of claim 19, wherein the program is further configured to calculate a thickness factor for a first perforated layer for each of the perforating tests, wherein the first perforated layer is a current layer, wherein the thickness factor is a function of thickness of a first layer of the wellbore layers to be perforated and a thickness of the current layer in the respective one of the perforation tests, wherein the estimate of the perforating operation is an estimate of a perforating outcome for the current layer of the wellbore layers to be perforated, and wherein perforating outcome is corrected where the thickness factor for at least one of the perforation tests is equal to or below a threshold.

21. A prediction system for perforation outcomes comprising:

database comprising a collection of perforating data, wherein the perforating data comprises perforating data for a plurality of perforation tests and the perforation tests comprise data for perforating through a plurality of perforated wellbore layers; and an information handling system comprising a processor and memory coupled to the processor, wherein the memory stores a program configured to:

obtain one or more variables for a perforating operation, wherein the variables comprise thickness of wellbore layers to be perforated and type of material of the wellbore layers to be perforated;

determine an estimate of a perforating outcome for the perforating operation; and correct the perforating outcome to obtain a corrected perforating outcome by applying a weighting based on the perforating data from the database.

22. A prediction system for perforation outcomes comprising:

database comprising a collection of perforating data, wherein the perforating data comprises perforating data for a plurality of perforation tests and the perforation tests comprise data for perforating through a plurality of perforated wellbore layers; and an information handling system comprising a processor and memory coupled to the processor, wherein the memory stores a program configured to:

obtain one or more variables for a perforating operation, wherein the variables comprise thickness of wellbore layers to be perforated and type of material of the wellbore layers to be perforated;

calculate a thickness factor for a first perforated layer for each of the perforating tests, wherein the first perforated layer is a current layer, wherein the thickness factor is a function of thickness of a first layer of the wellbore layers to be perforated and a thickness of the current layer in the respective one of the perforation tests;

determine an estimate of a perforating outcome for the perforating operation, wherein the estimate of the perforating operation is an estimate of a perforating outcome for the current layer of the wellbore layers to be perforated; and correct the perforating outcome to obtain a corrected perforating outcome by applying a weighting based on the perforating data from the database, wherein perforating outcome is corrected where the thickness factor for at least one of the perforation tests is equal to or below a threshold.

* * * * *